United States Patent [19]

Hofman

[11] Patent Number: 4,716,596

[45] Date of Patent: Jan. 5, 1988

[54] GARMENTS

[76] Inventor: Velimir Hofman, Slangenburg 10, 1082 JW Amsterdam, Netherlands

[21] Appl. No.: 596,866

[22] Filed: Apr. 4, 1984

Related U.S. Application Data

[63] Continuation-in-part of Ser. No. 248,254, Mar. 30, 1981, abandoned.

[30] Foreign Application Priority Data

Apr. 25, 1980 [GB] United Kingdom ..... 8013710

[51] Int. Cl.[4] ..... A41D 17/02; A41D 1/22

[52] U.S. Cl. ..... 2/69; 2/61; 2/227; 2/269; 36/2 R

[58] Field of Search ..... 2/243 R, 61, 69, 227, 2/269; 36/2 R

[56] References Cited

U.S. PATENT DOCUMENTS

| | | | |
|---|---|---|---|
| 332,630 | 12/1885 | Way | 36/2 R |
| 1,367,065 | 2/1921 | McCrahon . | |
| 1,620,743 | 3/1927 | Stuart | 2/61 X |
| 2,248,454 | 7/1941 | Freimark | 2/61 X |
| 2,513,204 | 6/1950 | Riedel | 36/2 R |
| 3,594,821 | 7/1971 | Pierron | 2/227 |
| 4,110,845 | 9/1978 | Chellas | 36/2 R |

FOREIGN PATENT DOCUMENTS

| | | | |
|---|---|---|---|
| 470911 | 2/1929 | Fed. Rep. of Germany | 36/2 R |
| 1803765 | 5/1970 | Fed. Rep. of Germany | 2/227 |
| 1,363,957 | 5/1964 | France | 2/227 |
| 2475376 | 8/1981 | France | 36/2 R |
| 433338 | 4/1948 | Italy | 36/2 R |
| 1290353 | 9/1972 | United Kingdom | 2/227 |

*Primary Examiner*—H. Hampton Hunter

*Attorney, Agent, or Firm*—Irvin A. Lavine

[57] ABSTRACT

An article of dress comprising a first piece and a second piece. The first piece comprises a leg covering of decorative light weight material having an upper edge and a lower edge, and capable of being worn as a single unit covering only one leg. The first piece has a length whereby it is capable of extending from above the knee to below the knee of the wearer. The second piece covers a substantial portion of only one leg of the wearer, leaving the other leg exposed, whereby the first piece can be viewed when worn on the other leg of the wearer.

3 Claims, 17 Drawing Figures

GARMENTS

This is a continuation in part of U.S. patent application Ser. No. 248,254 filed Mar. 30, 1981 entitled "Garment" and now abandoned.

BACKGROUND OF THE INVENTION

The present invention relates to improvements of articles of dress, for wear on the leg both indoors and outdoors.

DESCRIPTION OF THE PRIOR ART

Many articles of dress extending at least in part over the lower part of the body are known, such as dresses, skirts, trousers and breeches. These are all suitable for both indoor and outdoor wear.

There are other articles of protective clothing, such as raincoats and leg protectors, which cover at least part of the lower part of the body, but are not intended for both indoor and outdoor wear, and accordingly do not constitute an article of dress as defined and used in this specification.

Other articles covering at least in part the lower part of the body are described by Way (U.S. Pat. No. 332,630) and McCrahon (U.S. Pat. No. 1,367,065). These are glove-fitting, that is, they adhere close to the part of the human body it extends over, over its full length.

SUMMARY OF THE INVENTION

The present invention is directed to an article of dress which extends at least in part over the lower part of the body and can be worn both indoors and outdoors.

It is therefore a primary object of the invention to provide an outer garment which can be worn continuously all day in a normal manner both indoors and outdoors.

It is another object of the invention to provide an article of dress having different sections which can be tight-fitting, partially tight-fitting, loose-fitting, or partially lose-fitting.

It is still another object of the invention to provide an article of dress which can be worn in combination with at least one other article of apparel covering at least the upper and middle part of the body.

DETAILED DESCRIPTION OF THE INVENTION

The foregoing and other objects of the invention are achieved by provision of an article of dress comprising a tubular shape with irregular cylindrical dimensions. The irregular cylindrical dimensions enable the article to be, variously, loosefitting, tight-fitting, or a combination thereof.

The article of dress according to the invention, can be made out of various types of material, including but not limited to materials presenting a substantially continuous surface, materials presenting a discontinuous surface, as described hereinafter, materials partially incorporating non-foldable materials (such as metals, plates and shells), at least partly foldable materials and combinations thereof. Generally, a water resistant material (fabric) or an all-purpose water-repellent fabric (material) will not be utilized as the article of dress according to the invention is not made for protection against wet weather or inclement weather conditions.

The article of dress according to the invention consists of three principal sections, an upper section, a middle section, and a lower section. The middle section covers from about 2 inches above to about 2 inches below the kneecap. The upper section and the lower section cover the areas respectively above and below the middle section. The fit of the tubing in each of the three sections can be either loose-fitting, that is not adhering to the leg, tight-fitting, that is adhering to the leg, or partially loose-fitting, or partially tight-fitting, as defined hereinafter. The article is made to fit in such a way that it has a shape distinct from that of a leg and when worn is partly freely suspended. All types of fit within one section (partially loose-fitting, loose-fitting, partially tight-fitting and tight-fitting) are possible and can be used in any arrangement desired. When a plurality of types of fit are provided in one section, either tight-fitting or loose-fitting will dominate the overall fit of one complete section of the tubing. The article of dress comprises at least two different fits of partly loose-fitting and partly tight-fitting.

For the various types of fits the following definitions are used:

(a) Loose-fitting means that the fitting is loose-fitting throughout the complete length of the section.

(b) Partially loose-fitting means there is more than one type of fit within the section and that loose-fitting dominates the overal fit of the section.

When the fit of a particular portion of the tubing is partly loose-fitting, the article of dress is also partly tight-fitting.

Because the article of dress according to the invention comprises a single unit of tubing for wear on one leg only, the wearer is free to choose whether or not two single units of tubing will be worn simultaneously instead of one single unit of tubing and whether, if two single units are worn, they are to be completely identical or not.

The article of dress according to the invention has a length allowing it to start from any part of the upper leg and to extend to any point of the lower leg and in the extreme to extend the full length of the leg. In general the length of the article of apparel is not critical. Accordingly it is possible to design and adapt the article of dress to cover the required number of sizes for individual wearers by a limited number of sizes as far as the length of the article of dress is concerned.

The hemline can be parallel to the floor, at an angle to the floor, or a combination of the two.

The hemline can also consist of varieties of uneven lines consisting of at least two lines placed at an angle to each other. Examples include but are not limited to a zig-zag line, an undulating line and a curve. The hemlines also can be continuous or discontinuous, such as when formed by fringe or of a plurality of pieces of material at the hemline.

The article of dress can have any combination of continuous and discontinuous hemlines.

The article of dress can be formed from one piece of material, of which two sides are at least partly connected to each other, or from two or more pieces of material of which the sides are at least partly connected to each other, in any suitable manner utilizing at least one kind of connecting means, such as for example a seam, a zipper, self-adhesive tape, snaps, strings or knots or any other means for fastening together at least partly two sides of one piece of material. The article of dress can also contain more than one seam or another suitable connecting means.

If the article of dress includes more than one connecting means, these means can be colinear with each other and either adjacent to or spaced apart from each other. They can also be parallel to each other and even be positioned at an angle to each other. The connecting means also can be formed in straight lines or irregular lines.

The size and shape of the piece or pieces of material from which the article of dress is made is determined by the design and fit of the article. Accordingly, there are no limitations to the arrangement or position of the particular connecting means.

The material used to make the article of dress comprises at least in part foldable material, which can be located at any position in the article of apparel. The material also can comprise in part non-foldable material, which also can be located at any position.

The article of dress can have a substantially continuous surface, that is a surface having at most minute discontinuities, such as in cloth as used for suits or dresses, or a discontinuous surface, in which the discontinuities are of considerable size.

The discontinuous surface can comprise see-through openings and/or large openings. The openings can be made in the material itself, alternatively by cutting off or shaping the material or by cutting out pieces of the article of apparel. The openings can also be made as the result of the arrangement of the various pieces of material. The openings can be of regular size at regular (=equal) distances, regular size at irregular (=unequal) distances, irregular size at regular distances, irregular size at irregular distances and combinations thereof.

In another embodiment of the invention the article of dress can include at least one inflatable air-pocket. The air-pocket can be provided with at least one air-tube and an air-valve located in such a manner, that it is easily accessible if required. Protective material can be attached to the tubing or the lining of the article of apparel to cover the air-tube or the complete air-pocket system from inside. The air-valve can be positioned in a stitched-on -pocket, located on the outside part of the article of dress or alternatively in a built-in pocket on the inside of the article of dress. The air-valve allows inflation of the air-pocket to any desired degree using any suitable gas, preferably air. An inflated air-pocket can be used to attach the article of dress to the leg. This may allow better blood circulation and better prevent slippage than some other conventional attachment means for attaching the article of dress to the leg. Additionally the inflated air-pocket can provide a desired shape under the article of dress. One may wish to inflate the air-pocket, for example only, as the attachment means, for fashionable reasons, to hide and/or improve the form of a leg, for temperature insulation purposes and for other reasons. For young children one might wish to inflate the area of the knee to protect it against injuries. The air-pocket according to the invention can be located at any position of the article of dress and in any arrangement, size and number.

The air-valve can be located directly on the air-pocket (eliminating the air tube). Also the protective material utilized for covering the air-tube or the air-pocket system is not compulsory.

The air-pockets can be located within the article of dress when the tubing is made out of air-tight material, or the air-pockets can be fastened to the tubing.

The article of dress always covers the knee and the kneecap and at least partly covers the upper and lower leg. The upper part of the upper leg can be at least partly uncovered.

Irrespective of the number of pieces of material the article of dress is made of, the tubing can include auxiliary articles such as functional buttons, decorative buttons, buttonholes, pockets, decorative seams and built-in pockets.

The article of dress can also include attached articles located outside the plane of the tubing and attached to the tubing such as linings, fillings, pockets, reinforcements and straps.

The article of dress can be provided with a special pattern imposed on the surface to present a discontinuous surface to decrease the aeration inside the tubing and/or to add to the artistic and fashionable value. Special patterns, imposed onto the surface of the tubing, constitute attached articles as well.

An additional feature of the invention is that pockets and straps are suitable for carrying articles, such as for example pencils, keys or a purse.

The auxiliary and attached articles can be located at any position on the article of dress.

The article of dress according to the invention can be attached to the leg or any other suitable part of the body by attachment means in some conventional mode as for example by straps, strings, elastic materials, self-adhesive tapes, crimped fibres, a garter, a corset or the like.

The attachment means can constitute a part of the article of dress; alternatively they can be separate from the article of dress or as in the case of buttons and buttonholes or crimped fibres, for example, the attachment means can constitute partly a part of the article of dress and partly separate therefrom.

Generally, the attachment means will be placed circumferentialy around the leg, the exception being, as an example, self-adhesive tape which need extend only a part of the circumference of the article of dress.

The attachment means can be situated in the upper part of the tubing. When the attachment means is so situated, it can leave the upper end free and loose-fitting allowing it to be more easily put on. When no attachment means are utilized both the upper part of the tubing and the upper end of the tubing can be freely suspended or fitted in any other convenient way. On the lower part and lower end of the article of dress, conventional attachment means can be applied or the article of dress can be provided with various alternative fittings including fittings enabling the article of dress to be left completely freely suspended from the leg when worn. Alternatively the article of dress can be provided with a construction comprising a string or elastic or elastomer or elastic fibre, which gives the tubing the shape of harem trousers.

The article of dress according to the invention may or may not comprise attachment means of its own. The spirit of the invention is not changed when the attachment means utilized attach to any other suitable part of the body.

In another embodiment, the article of dress includes a pressed-in crease or a plurality of pressed-in creases.

In addition, the article of dress according to the invention can be provided with cuffs at the lower end.

The article of dress according to the invention can be translucent, transparent or opaque, as desired. It can consist of any suitable materials such as woven or knitted materials manufactured from natural fibres, man-made fibres, or materials not made out of fibres and any mixture thereof; natural fibres consisting of celluloe base, protein base or mineral base fibres and man-made fibres consisting of natural polymer base, synthetic polymer base and inorganic base fibre, as well as non-woven materials, such as leather, synthetic leather, rubber, plastic foils, plates and other forms made of different types of materials; rubber and any mixture thereof; as well as any mixture of materials made out of fibres and materials which are not made out of fibres.

Because the article of dress covers the leg only, the material used in making it can be a very light material and/or transparent material as articles of dress covering the leg are subject to less tear and wear than articles covering the leg and some other part of the body.

The article of dress according to the invention can be made, for example, out of very lightweight transparent material, such as fabrics weighing 3.0 oz/yd$^2$. It is expected that such fabrics will not be particularly resistant to breaking and tearing according to ASTM Designation D 1682 and D 2262.

Two single units of tubing can be designed having no difference between the article of dress designed for the left leg and the right leg. To meet these requirements a very simplified version of the article of dress is designed comprising a middle line (theoretical line) with respect to which both sides are completely symmetrical.

A better understanding of the disclosed embodiments of the invention will be achieved when the accompanying detailed description is considered in conjunction with the appended drawings, in which the like reference numerals are used for the same parts illustrated in the different figures.

DESCRIPTION OF THE PREFERRED EMBODIMENTS

Figure 1:
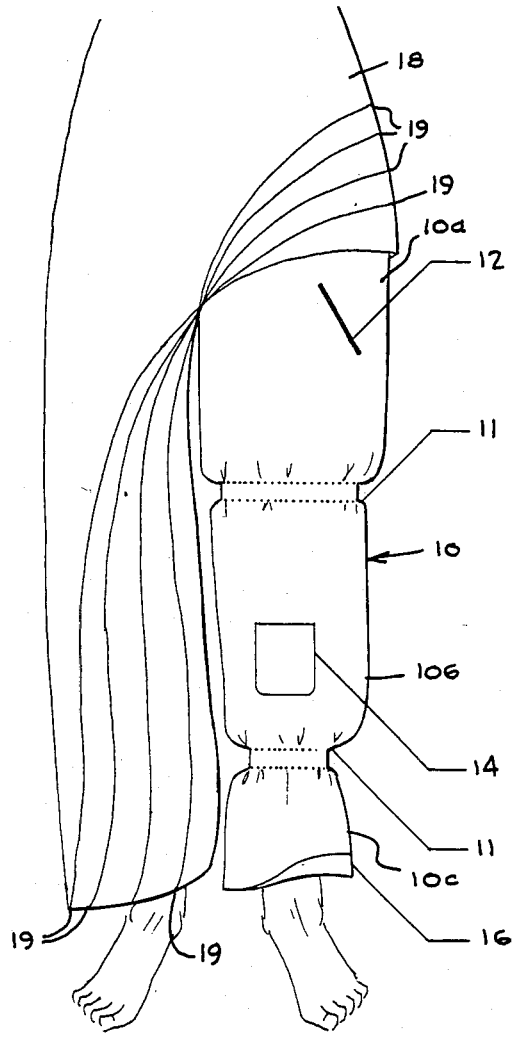
FIG. 1 is a front, elevational view of a first embodiment of the invention, in use on the lower part of the human body.

As shown in FIG. 1, tubing 10 covers an area from about the ischium down to about the ankle. The tubing 10 is fitted by means of elastic strips 11 allowing it to be partially loose-fitting in the upper section 10*a*, loose-fitting in the middle section 10*b* and partially loose-fitting in the lower section 10*c*. Elastic strips 30 are placed at the upper and lower ends of the middle section 10*b* of tubing 10. In the upper section 10*a* is a built-in pocket 12 and in the lower section 10*c* is a stitched-on pocket 14. The extreme lower part of tubing 10 is partly turned inside out to show a lining 16.

Tubing 10 is shown in combination with a dress 18 having a plurality of permanent folds 19, to show how a single unit of tubing can be worn on one leg only.

Dress 18 is a part of an aritcle of dress and will be seen to cover at least a portion of the torso of the wearer in the region of the ischium, that is, the abdomen and hips, and also covers a substantial portion of one leg, only, of the wearer; the other leg of the wearer is thereby exposed, permitting the viewing of tubing 10 when worn on the other leg of the wearer.

Figure 2:
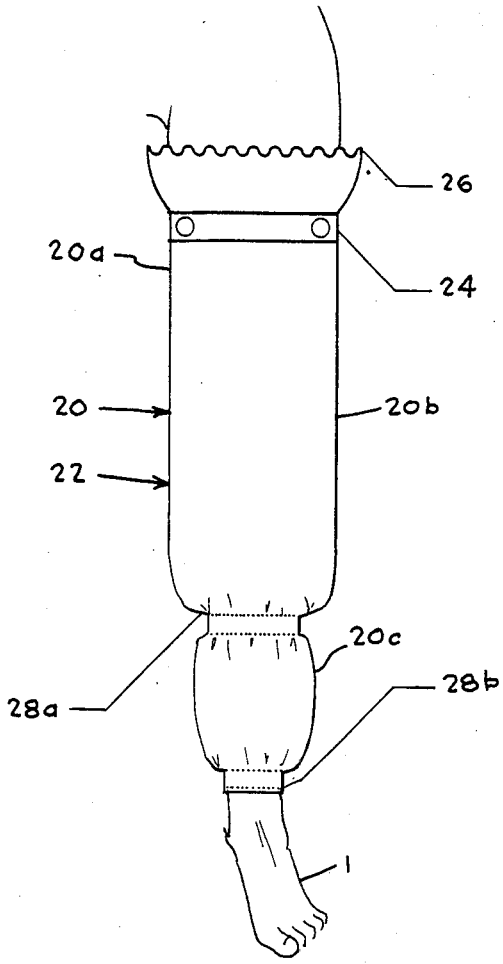
FIG. 2 is a front, elevational view of a second embodiment of the invention, in use on a human left leg.

As shown in FIG. 2, tubing 20 comprises one piece of material 22. The tubing covers the area from somewhere on the upper part of the leg to the ankle. The tubing is tight-fitting in the middle part of the upper section 20*a*, loose-fitting in the middle section 20*b* and partially loose-fitting in the lower section 20*c*. The upper part of the tubing 20 is attached to the leg with attachment means 24, located below the loose-fitting upper end 26. The tubing 20 is tight-fitting at two locations determined by elastic strips 28*a* and 28*b*. Between these two locations of elastic strips 28*a* and 28*b* the tubing 20 is loose-fitting.

Figure 3:
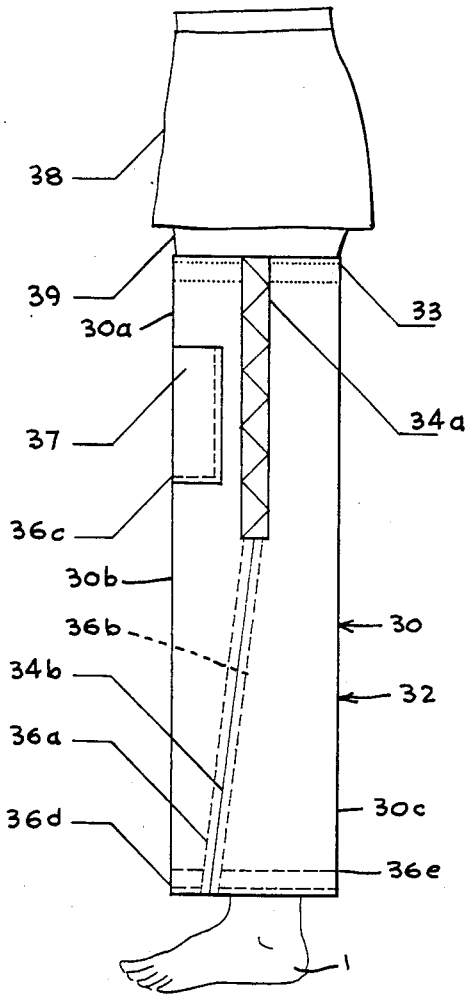
FIG. 3 is a left, side elevational view of a third embodiment of the invention, in use on a human left leg.

As shown in FIG. 3, tubing 30 comprises one piece of material 32, covering the area from the ankle to below the highest part of the inner side of the leg. The tubing 30 is partially loose-fitting in the upper section 30*a* and loose-fitting in both the middle and lower sections 30*b* and 30*c*. An elastic strip 32 located at the extreme upper part of tubing 30 serves as attachment means to attach tubing 30 to the leg 1. Two sides of piece of material 32 are connected to each other by two connecting means 34*a* and 34*b* at an angle to each other. Connecting means 34*b* is a seam. Parallel with connecting means 34*b* are decorative seams 36*a* and 36*b*. In the front part of tubing 30 is a pocket 37. Decorative seams 36*c*, 36*d*, and 36*e* are also placed on pocket 37 and the extreme lower part of tubing 30. Tubing 30 is shown worn in combination with a skirt 38 and there is a gap 39 between skirt 38 and tubing 30 at which the leg 1 shows.

Figure 4:
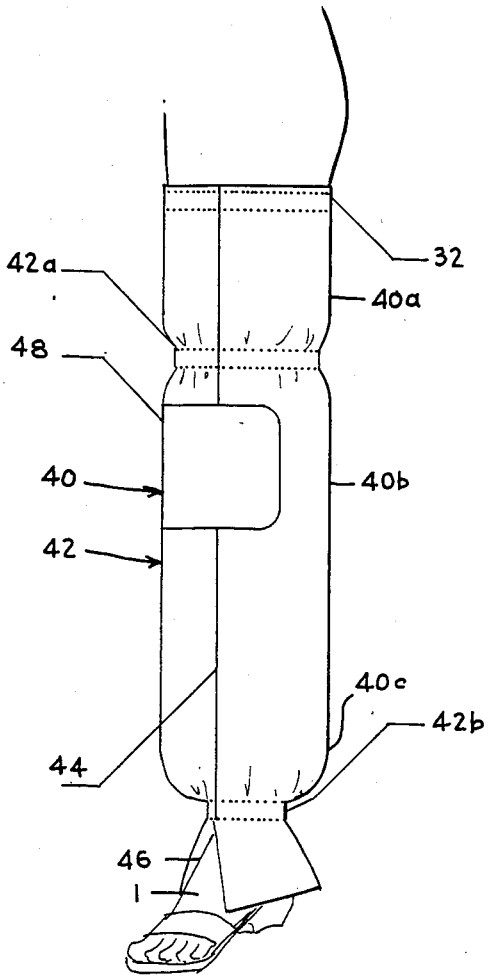
FIG. 4 is a left, side elevational view of a fourth embodiment of the invention, in use on a human left leg.

As shown in FIG. 4, tubing 40 comprises one piece of material 42, covering an area from the upper part of a leg to the extreme lower part of the leg. Tubing 40 is partially loose-fitting on the upper section 40*a*, loose-fitting at the middle section 40*b* and partially loose-fitting at the lower section 40*c*. Tubing 40 is fitted by attachment means comprising elastic strips 42*a* and 42*b*, which are tight-fitting on the leg 1. Connecting means comprising a seam 44 connects two ends of piece of material 42 in order to form tubing 40. Tubing 40 further comprises an opening 46 on the lower section of tubing 40 and a reinforcement patch 48.

Figure 5:
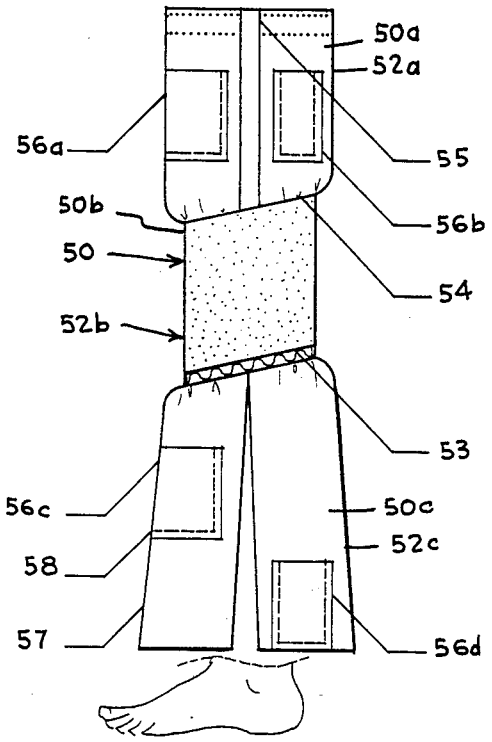
FIG. 5 is a left, side elevational view of a fifth embodiment of the invention, in use on a human left leg.

As shown in FIG. 5, tubing 50 comprises a plurality of pieces of material 52*a*, 52*b*, and 52*c*, covering an area from the upper leg to the ankle. Tubing 50 is partially loose-fitting at the upper section 50*a*, tight-fitting at the middle section 50*b* and loose-fitting at the lower section 50*c*. The three pieces of material 52*a*, 52*b*, and 52*c* are interconnected by interconnecting means 53 and a seam 54 positioned parallel to each other. The upper section 50*a* of tubing 50 includes connecting means comprising self-adhesive tape 55, which can be opened. The middle section 50*b* of tubing 50 is made out of elastic material, so that the complete area around the knee is tight-fitting on the leg 1. The tubing 50 is provided with four pockets 56*a*, 56*b*, 56*c*, and 56*d* in various positions and the lower part 50*c* of tubing 50 includes an opening 57. Pockets 56*a*, 56*b*, 56*c*, and 56*d* are provided with decorative stitching 58.

Figure 6:
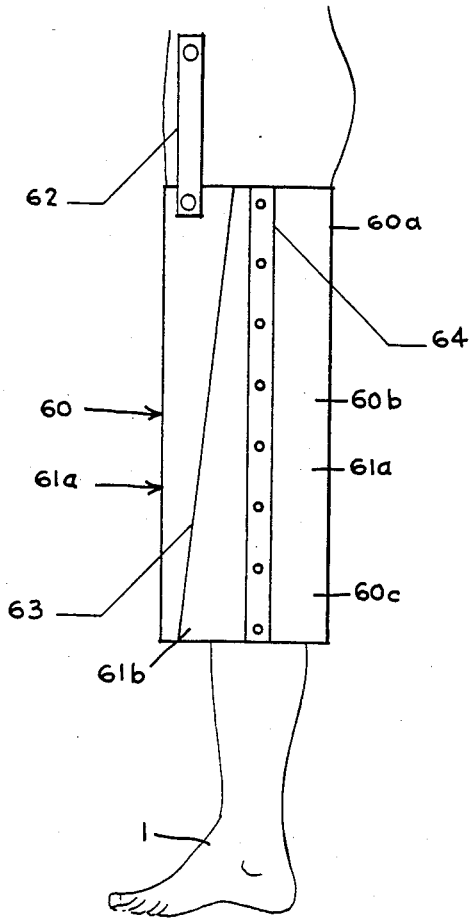
FIG. 6 is a left, side elevational view of a sixth embodiment of the invention, in use on a human left leg.

As shown in FIG. 6, tubing 60 comprises a plurality of pieces of material 61*a* and 61*b*, covering an area from around the ischium down to an area on the leg high above the ankle. Tubing 60 is the same diameter as the leg 1 near the ischium and therefore is tight-fitting at the upper section 60*a* and loose-fitting at the middle section 60*b* and the lower section 60*c*. Tubing 60 further comprises attachment means such as a garter 62 for attaching tubing 60 to a suitable part of the body other than the leg 1. Pieces of material 61*a* and 61*b* are connected by interconnecting means 63 and 64, positioned at an angle with respect to each other. Interconnecting means 63 and 64 comprise a seam and a line of snaps, respectively.

Figure 7:
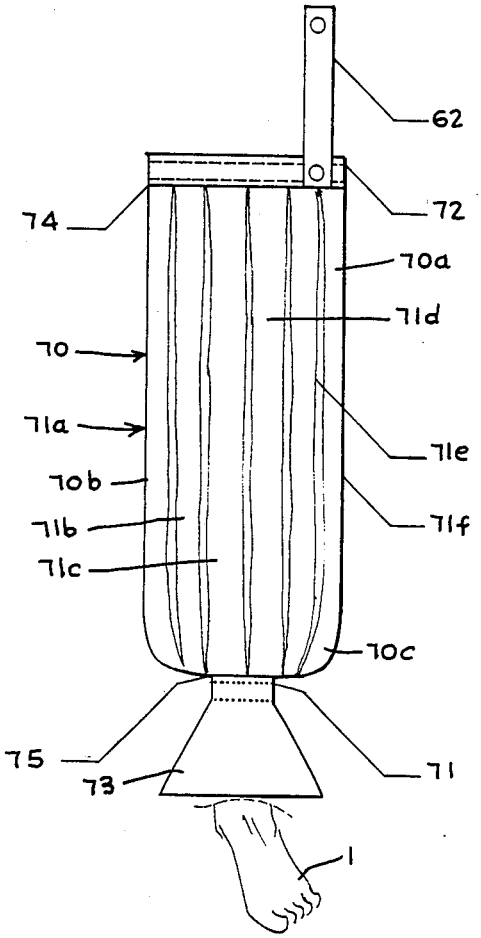
FIG. 7 is a front, elevational view of a seventh embodiment of the invention, in use on a human left leg.

As shown in FIG. 7, tubing 70 comprises a plurality of pieces of material 71*a*, 71*b*, 71*c*, 71*d*, 71*e*, 71*f*, etc., covering an area from the upper leg to the ankle. Tubing 70 is loose-fitting at the upper and middle sections 70*a* and 70*b* and partly tight-fitting with an elastic strip 71 positioned in the lower section 70*c*, leaving the lower part of the lower section 70*c* loose and thus freely suspended from the leg 1. The pieces of material 71*a*, 71*b*, etc. are interconnected at the upper end by a ribbon type material 72 and by a trapezoidal-shaped piece of material 73 at the lower end. The ribbon type material 72 and the trapezoid-shaped piece of material 73 are connected to pieces of material 71*a*, 71*b*, etc. by seams 74 and 75, respectively.

Figure 8:
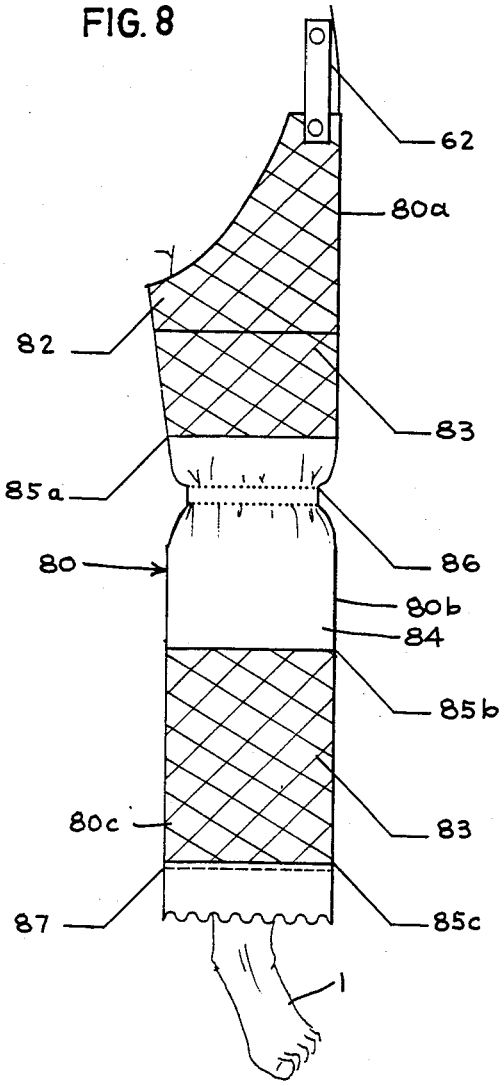
FIG. 8 is a front, elevational view of an eighth embodiment of the invention, in use on a human left leg.

As shown in FIG. 8, tubing 80 comprises a discontinuous surface including see-through openings and large openings covering an area from the hipbone down to the ankle. Tubing 80 is loose-fitting at the upper section 80*a*, partially loose-fitting at the middle section 80*b* and loose-fitting at the lower section 80*c*. Tubing 80 is made in part of a lining 82 and a netting material 83. For the middle section of tubing 80 different material 84 is used, interconnected by interconnecting means comprising seams 85*a*, 85*b*, and 85*c*. Netting material 83 comprises the upper section 80*a* and the lower section 80*b* respectively of tubing 80. An elastic strip 86 is used as attachment means. Tubing 80 further comprises a decorative seam 87.

Figure 9:
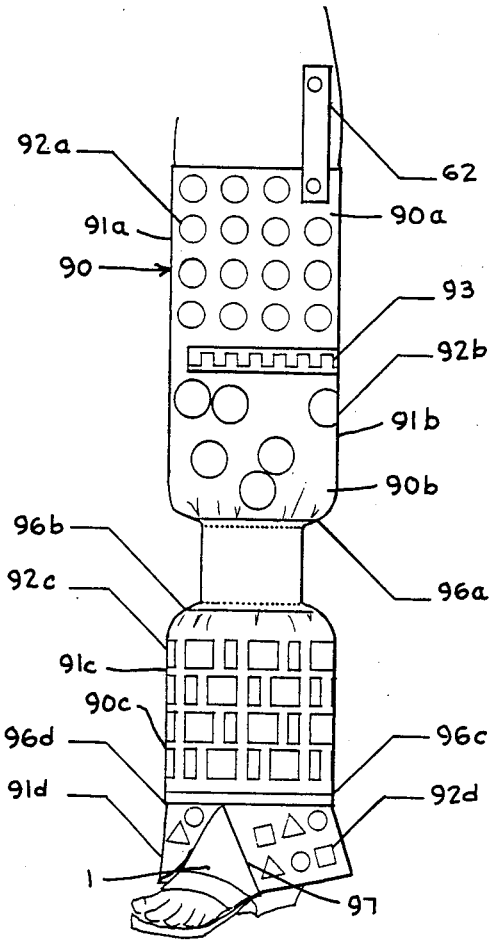
FIG. 9 is a left, side elevational view of a ninth embodiment of the invention, in use on a human left leg.

As shown in FIG. 9, tubing 90 comprises a discontinuous surface including see-through openings and large openings, covering an area from about the level of the ischium down to the extreme lower part of a leg 1. Tubing 90 is tight-fitting at the upper section 90*a* and partially loose-fitting at the middle and lower sections 90*b* and 90*c*. It is made out of four different interconnected sections of material 91*a*, 91*b*, 91*c*, and 91*d* with interstices and other materials interconnected to form a tube. First material 91*a* has regularly shaped openings 92*a* at regular distances and other regularly shaped openings 92*b* at irregular mutual distances, second material 91*b* has no openings, third material 91*c* has irregularly shaped openings 92*c* at regular mutual distances and fourth material 91*d* has irregularly shaped openings 92*d* at irregular mutual distances. A zig-zag seam 93 partly interconnects pieces of material 91*a* and 91*b*. Ribbon type material 94 and 95 and seams 96*a*, 96*b*, 96*c*, and 96*d* interconnect pieces of material 91*b*, 91*c*, and 91*d*. Tubing 90 further comprises an opening 97.

Figure 10:
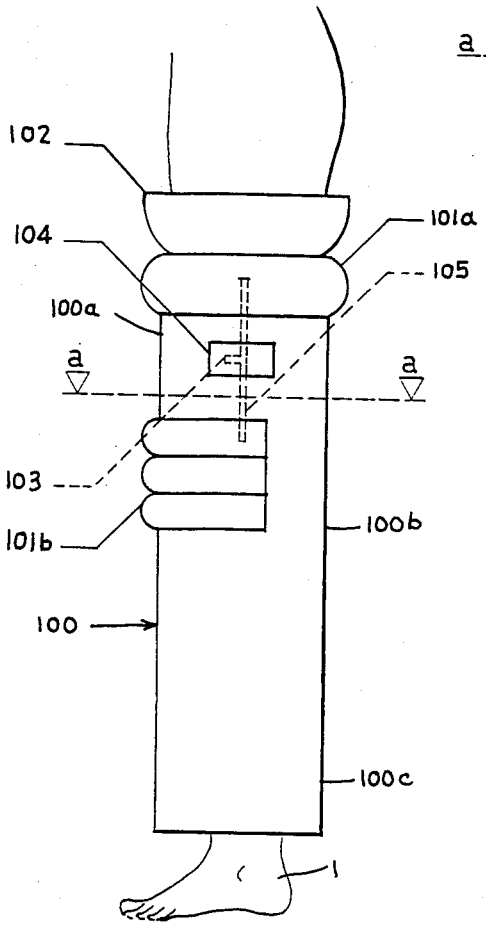
FIG. 10 is a left, side elevational view of a tenth embodiment of the invention, in use on a human left leg.
Figure 11:
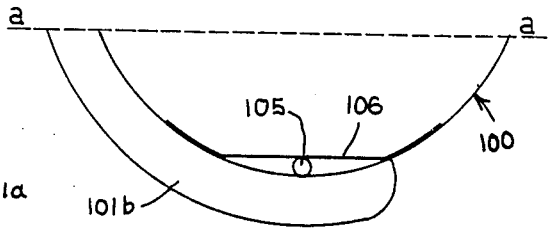
FIG. 11 is a cross-sectional view of the embodiment of FIG. 10, taken along line a—a of FIG. 10.

As shown in FIG. 10, tubing 100 includes inflatable airpockets 101*a* and 101*b* and covers an area from the upper leg to the ankle. The tubing 100 is partially loose-fitting in the upper section 100*a* and loose-fitting in the upper end. The upper end is provided with gripping means 102 for aiding in pulling up tubing 100 over the leg. The middle section 100*b* and lower section 100*c* are loose-fitting. An air-pocket 101*a* in the upper section provides a round shape and serves as attachment means for attaching tubing 100 to the leg. Tubing 100 further comprises a lower air-pocket 101*b* in the middle section 100*b* in the vicinity of the knee which is tight-fitting on the leg 1. An air valve 103 positioned in a conventional pocket 104 is connected to air pockets 101*a* and 101*b* by air-tubes 105. As shown in FIG. 11, air-tubes 105 are covered on the side of tubing 101 towards the leg, by another material 106 attached to tubing 100, for example by gluing. The leg 1 is thus prevented from being in direct contact with air-tubes 105.

Figure 12:
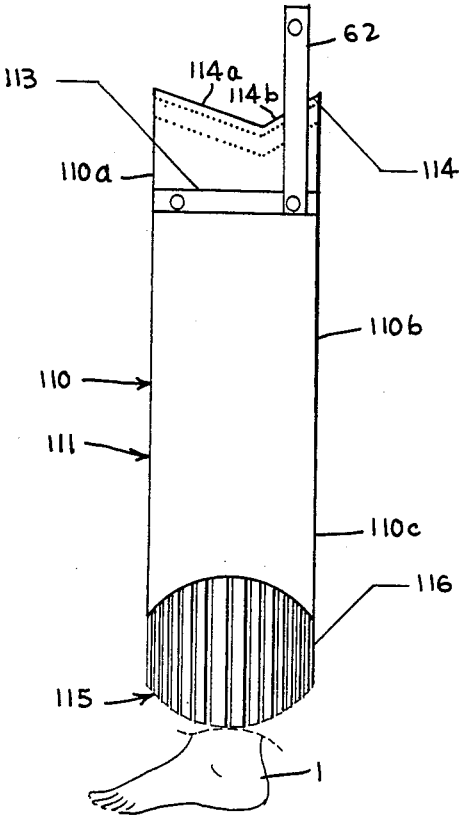
FIG. 12 is a left, side elevational view of an eleventh embodiment of the invention, in use on a human left leg.

As shown in FIG. 12, tubing 110 comprises one piece of material 111, covering an area from the ankle to about the highest part of the inner side of the leg 1. Tubing 110 is partly tight-fitting in the upper section 110*a*, the extreme upper part of the upper section being provided with an elastic strip 112, and loose-fitting both in the middle and lower sections 110*b* and 110*c*. Attachment means 113 attaches tubing 110 to any suitable part of the body. The upper hemline 114 is uneven, consisting of two lines 114*a* and 114*b* each one of which is at an angle to the floor. The lower hemline 115 comprises fringes 116.

Figure 13:
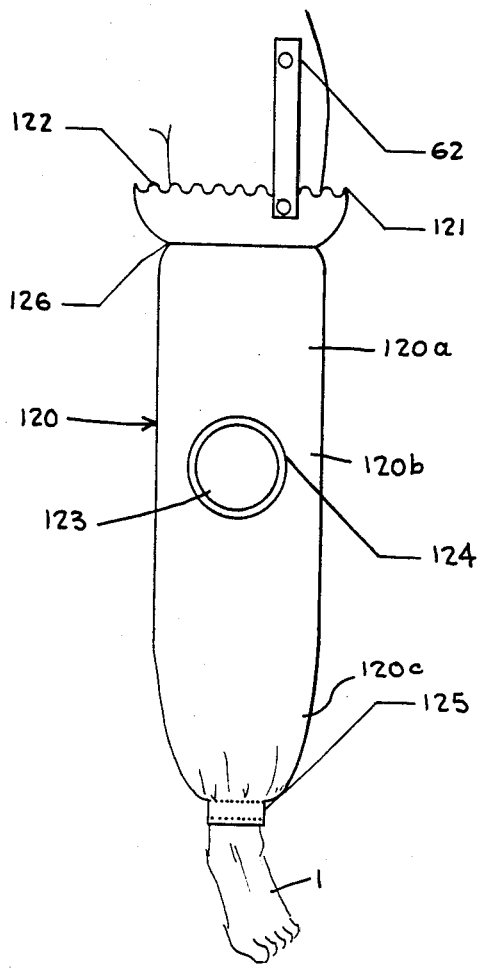
FIG. 13 is a front, elevational view of a twelfth embodiment of the invention, in use on a human left leg.

As shown in FIG. 13, tubing 120 comprises a discontinuous surface including see-through openings and large openings, covering an area from the upper part of the leg 1 to the ankle. Tubing 120 is partly tight-fitting on the upper section 120*a*, loose-fitting in the middle section 120*b* and partly tight-fitting in the lower section 120*c*. The upper part 121 of the upper section is loose-fitting, and is connected to the remainder of upper section 120*a* by a seam 126. Tubing 120 is attached to a suitable part of the body other than a leg by attachment means 62. The upper end has an undulating hemline 122. A large opening 123 in the material has a soft edge 124. The lower end of tubing 120 is made tight-fitting by elastic strip 125.

Figure 14:
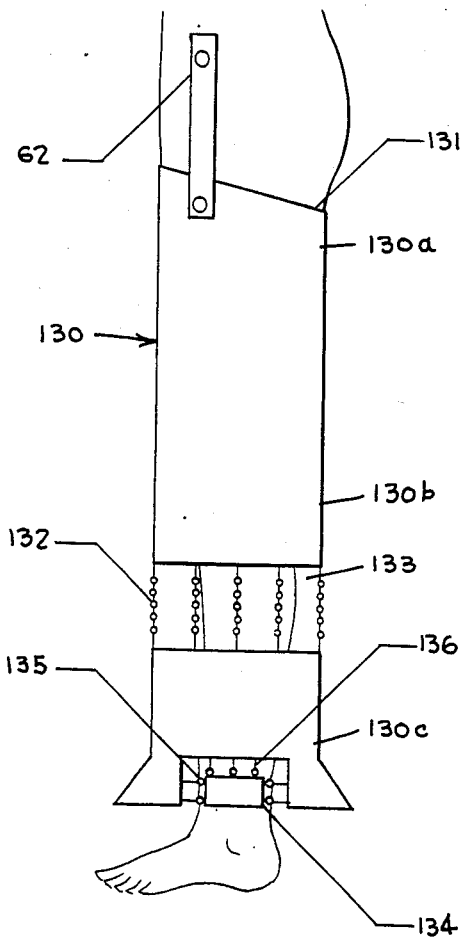
FIG. 14 is a left, side elevational view of a thirteenth embodiment of the invention, in use on a human left leg.

As shown in FIG. 14, tubing 130 comprises a discontinuous surface including see-through openings and large openings, covering an area from the ankle to below the highest part of the inner side of the leg. Hemline 131 at the upper end of tubing 130 is nonparallel to the ground. Tubing 130 is partially tight-fitting on the upper section 130*a*, the upper part of the upper section being tight-fitting, and loose-fitting at both the middle and lower sections 130*b* and 130*c*. Chains 132 fasten two sections 130*b* and 130*c* of tubing 130, in part leaving an open space between them. A metallic plate 134 is attached to tubing 130 by eye-screws 135 and thin strong cords 136. Tubing 130 as shown in FIG. 14 thus incorporates non-foldable materials.

Figure 15:
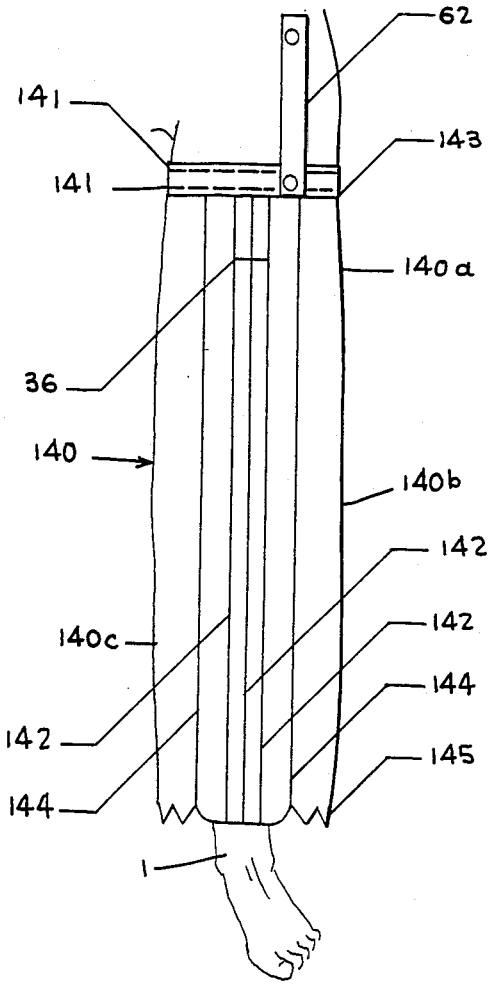
FIG. 15 is a front, elevational view of a fourteenth embodiment of the invention, in use on a human left leg.

As shown in FIG. 15, tubing 140 comprises a substantially continuous surface. Tubing 140 is partially loose-fitting at the upper section 140*a*, exceedingly loose-fitting at the middle section 140*b* and loose-fitting at the lower section 140*c*. The upper end is decorated with decorative seams 141. Tubing 140 is provided with a plurality of pressed-in creases 142, and covers an area from the upper leg down to slightly above the ankle. Tubing 140 further includes a horizontal seam 143 and a plurality of vertical seams 144. The lower hem-line 145 comprises a combination of zig-zag lines, curved lines and a straight line parallel to the floor.

Figure 16:
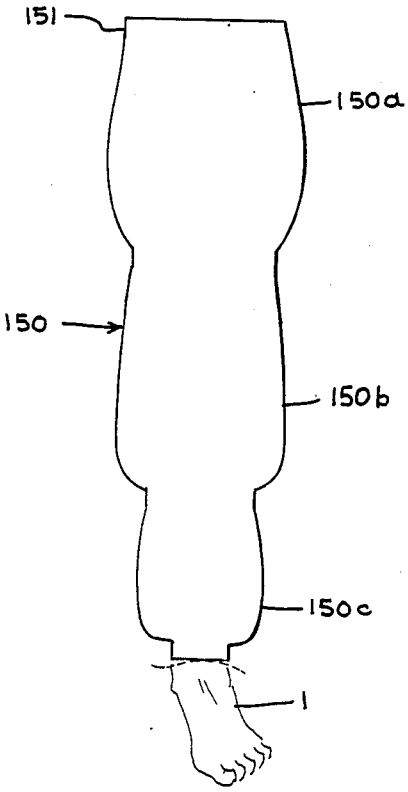
FIG. 16 is a front, elevational view of a fifteenth embodiment of the invention, in use on a human left leg.

As shown in FIG. 16, tubing 150 covers an area from the upper leg down to the ankle. The tubing 150 is tight-fitting and loose-fitting in each of the upper, middle and lower sections 150*a*, 150*b*, and 150*c*. The extreme upper part 151 of tubing 150 is tight-fitting.

Figure 17:
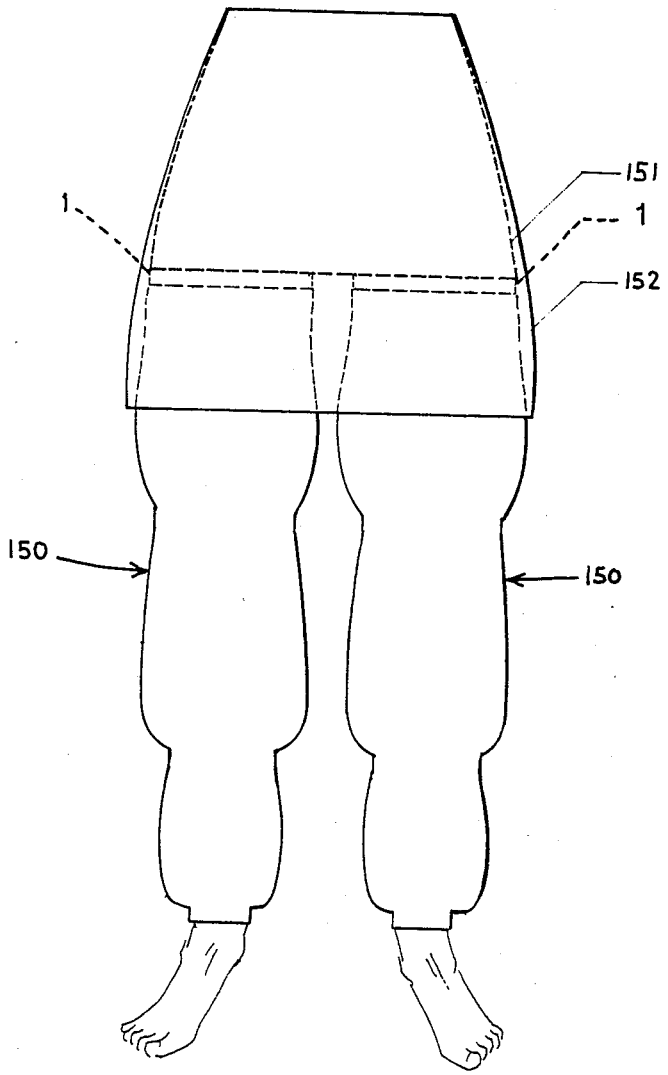
FIG. 17 is a front, elevational view of a sixteenth embodiment of the invention, in use on the lower part of a human body.

FIG. 17 shows two identical tubings 150 worn simultaneously on both legs. As shown, tubings 150 can be worn in combination with a short skirt 151, a longer skirt 152, or some other article of apparel.

I claim:

1. Article of dress for use as a decorative leg covering of a single leg, said article being tubing of decorative light weight material and capable of being worn as a single unit covering only one leg, (a) said article extending when worn by a wearer from above the knee to below the knee;

(b) said article having upper and lower terminal edges and supporting means spaced therefrom comprising at least first and second spaced apart tight fitting attachment portions for engaging a part of the leg of the wearer for supporting the article thereon;

(c) said article having a first loose fitting portion at said upper edge adjacent said first tight fitting attachment portion, said first loose fitting portion extending between said first tight fitting portion and said upper edge and being positioned above said tight fitting attachment portion when worn by the wearer, whereby to allow ambient air to engage at least a portion of the leg of the wearer above the knee;

(d) said article having a second loose fitting portion at said lower edge adjacent said second tight fitting attachment portion, said second loose fitting portion extending between said second tight fitting portion and said lower edge, whereby to allow ambient air to engage at least a portion of the leg of the wearer below the knee; and (e) said article having a third loose fitting portion extending between said first and second tight fitting attachment portions, whereby to allow ambient air to engage at least a portion of the leg of the wearer between said first and second tight fitting attachment portions.

2. An article of dress for use as a decorative leg covering for a single leg, said article being tubing of decorative light weight material and capable of being worn as a single unit covering only one leg, (a) said article extending when worn by a wearer from above the knee to below the knee;

(b) said article having upper and lower terminal edges and supporting means spaced from said edges comprising at least one tight fitting attachment portion for engaging a part of the leg of the wearer for supporting the article thereon;

(c) said article having a first loose fitting portion at said upper edge adjacent said tight fitting attachment portion, said first loose fitting portion extending between said tight fitting portion and said upper edge and being positioned above said tight fitting attachment portion when worn by the wearer, whereby to allow ambient air to engage at least a first portion of the leg of the wearer; and (d) said article having a second loose fitting portion intermediate said tight fitting attachment portion and said lower edge, whereby to allow ambient air to engage at least a second portion of the leg of the wearer.

3. Article of dress for use as a decorative leg covering for a single leg, said article being tubing of decorative light weight material and capable of being worn as a single unit covering only one leg, (a) said article extending when worn by a wearer from above the knee to below the knee;

(b) said article having upper and lower terminal edges and supporting means spaced therefrom comprising at least one tight fitting attachment portion for engaging a part of the leg of the wearer for supporting the article thereon;

(c) said article having a first loose fitting portion at said upper edge adjacent said tight fitting attachment portion, said loose fitting portion extending between said tight fitting portion and said upper edge and being positioned above said said tight fitting attachment portion when worn by the wearer, whereby to allow ambient air to engage at least a portion of the leg of the wearer above the knee; and (d) said article having a second loose fitting portion at said lower edge, whereby to allow ambient air to engage at least a portion of the leg of the wearer below the knee.

* * * * *